US009785106B2

(12) United States Patent
Maeyama

(10) Patent No.: US 9,785,106 B2
(45) Date of Patent: Oct. 10, 2017

(54) IMAGE FORMING APPARATUS AND METHOD FOR CONTROLLING AN AMOUNT OF LUBRICANT APPLIED ON THE IMAGE CARRIER

(71) Applicant: Konica Minolta, Inc., Chiyoda-ku, Tokyo (JP)

(72) Inventor: Takeshi Maeyama, Ikeda (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/333,263

(22) Filed: Oct. 25, 2016

(65) Prior Publication Data

US 2017/0115623 A1 Apr. 27, 2017

(30) Foreign Application Priority Data

Oct. 26, 2015 (JP) ..... 2015-209716

(51) Int. Cl.
*G03G 21/00* (2006.01)

(52) U.S. Cl.
CPC ..... *G03G 21/0094* (2013.01)

(58) Field of Classification Search
CPC ..... G03G 21/0094
USPC ..... 399/346
See application file for complete search history.

(56) References Cited

U.S. PATENT DOCUMENTS 4,786,976 A * 11/1988 Takao ..... H04N 1/4055 358/2.1
2011/0268466 A1* 11/2011 Kimura ..... G03G 15/757 399/71
2013/0017006 A1* 1/2013 Suda ..... G03G 15/5008 399/346
2015/0160600 A1* 6/2015 Saito ..... G03G 21/0094 399/346
2015/0331357 A1* 11/2015 Tsukamura ..... G03G 15/0848 399/53

FOREIGN PATENT DOCUMENTS

JP 2009-069582 A 4/2009
JP 2010-169793 A 8/2010

* cited by examiner

*Primary Examiner* — Walter L Lindsay, Jr.
*Assistant Examiner* — Arlene Heredia Ocasio
(74) *Attorney, Agent, or Firm* — Buchanan Ingersoll & Rooney PC

(57) ABSTRACT

An image forming apparatus includes: a rotatable image carrier; an image forming unit configured to form an electrostatic latent image on the image carrier based on information defining at least one of a toner region and a non-toner region; a development unit configured to develop the electrostatic latent image as a toner image; a cleaning unit configured to remove toner remaining on the image carrier, after transfer of the toner image; an application unit configured to apply lubricant on the image carrier; and a hardware processor configured to control an amount of the lubricant applied, calculate a ratio of a toner region for each of regions obtained by dividing a surface of the image carrier in a direction perpendicular to a rotation direction of the image carrier, and control the amount of the lubricant applied according to a difference between a maximum value and a minimum value of the ratio.

11 Claims, 13 Drawing Sheets

FIG. 5

122

| | | | | | | | | |
|---|---|---|---|---|---|---|---|---|
| 0 | 0 | 0 | 1 | 1 | 1 | 0 | 0 | 0 |
| 0 | 0 | 0 | 1 | 1 | 1 | 0 | 0 | 0 |
| 0 | 0 | 0 | 1 | 1 | 1 | 0 | 0 | 0 |
| 1 | 1 | 1 | 1 | 1 | 1 | 1 | 1 | 1 |
| 1 | 1 | 1 | 1 | 1 | 1 | 1 | 1 | 1 |
| 1 | 1 | 1 | 1 | 1 | 1 | 1 | 1 | 1 |
| X1 | X2 | ··· | Xi | ··· | Xj | ··· | ··· | Xn |

125

| REGION | X1 | X2 | ··· | Xi | ··· | Xj | ··· | ··· | Xn |
|---|---|---|---|---|---|---|---|---|---|
| IMAGE PORTION RATIO | 50 | 50 | ··· | 100 | ··· | 100 | ··· | ··· | 50 |

IMAGE FORMING APPARATUS AND METHOD FOR CONTROLLING AN AMOUNT OF LUBRICANT APPLIED ON THE IMAGE CARRIER

The entire disclosure of Japanese Patent Application No. 2015-209716 filed on Oct. 26, 2015 including description, claims, drawings, and abstract are incorporated herein by reference in its entirety.

BACKGROUND OF THE INVENTION

Field of the Invention

The present disclosure relates to a control of an image forming apparatus, and in particular relates to a control of an electrophotographic image forming apparatus.

Description of the Related Art

Electrophotographic image forming apparatuses have been widely used. The electrophotographic image forming apparatuses each perform a printing process including the steps of rotating an image carrier while uniformly charging the image carrier, exposing the image carrier to form an electrostatic latent image, applying toner to the electrostatic latent image on the image carrier, transferring a toner image on the image carrier to an object on which printing is to be performed, removing the toner remaining on the image carrier using a cleaning blade after transfer of the toner image, and applying lubricant to the image carrier.

A method of applying the lubricant on the image carrier uses for example, a lubricant application mechanism and a toner additive. The lubricant application mechanism is configured so that a brush is rotated and made contact with a solid lubricant called lubricant bar, and lubricant scraped by the brush is supplied to a surface of the image carrier. In the toner additive, a lubricant is added to toner, the toner forms a toner image, and the lubricant is supplied to the surface of the image carrier through the toner.

The lubricant applied over the image carrier is reduced due to accumulation of the toner, toner additive, or the like on the cleaning blade. That is, the amount of reduction in lubricant on the image carrier varies depending on the amount of toner accumulated on the cleaning blade. In a portion having a large amount of toner, the amount of reduction in lubricant on the image carrier is increased, and in a portion having a small amount of toner, the amount of reduction in lubricant on the image carrier is reduced. Therefore, even if the lubricant is uniformly applied over the image carrier, the amount of lubricant may be not uniform on the image carrier.

This may cause an uneven image (noise). FIGS. 13A and 13B are exemplary diagrams illustrating image unevenness. Let us assume that an image pattern 130 having a black center region 131 is continuously printed. In this case, the amount of reduction in lubricant on the image carrier is increased in a region corresponding to the center region 131, and is reduced in the other regions, on the image carrier. Adhesion between the image carrier and toner varies depending on the amount of lubricant, and even if uniform image pattern (whole half tone) is printed, unevenness is caused between the regions 136 and 137, as shown in an image 135. In order to prevent generation of image unevenness, it is important to make the lubricant on the image carrier uniform regardless of an image pattern.

As for a technique for inhibiting image unevenness, for example, JP 2009-69582 A discloses an image forming apparatus for "always making the amount of lubricant on an image carrier constant". JP 2010-169793A discloses an image forming apparatus for "maintaining a uniform amount of lubricant applied to a surface of an image carrier regardless of an image output".

With reference to FIGS. 14A to 14C, an example of a method of inhibiting the image unevenness will be described. FIGS. 14A to 14C are graphs each illustrating a relationship between the rotation rate of a lubricant application member and the amount of lubricant on the image carrier. Hereinafter, a toner region on the image carrier is also referred to as "image portion". A region on the image carrier to which toner is not applied is also referred to as "background portion".

Lower curves in graphs of FIGS. 14A to 14C each indicate change in amount of lubricant with respect to the rotation rate of the lubricant application member when the image portion is continued. Upper curves in the graphs of FIGS. 14A to 14C each indicate change in amount of lubricant with respect to the rotation rate of the lubricant application member when the background portion is continued. For example, as indicated in the graph of FIG. 14A, when the rotation rate of the lubricant application member is set to "A1", there is a difference "C1−B1" in amount of lubricant between the background portion and the image portion. This difference exceeds an allowable width W not causing the image unevenness, so that the image unevenness is caused.

An example of the method of inhibiting the image unevenness includes a method of reducing the rotation rate of the lubricant application member to reduce a difference in amount of lubricant between the background portion and the image portion, from "C1−B1" to "C2−B2", as shown in the graph of FIG. 14B. With this method, a difference in amount of lubricant is within the allowable width W, and the image unevenness is not generated. However, with this method, the amount of lubricant on the image carrier is lower than a threshold Th, and so-called toner fixation on the photoreceptor, that is, toner fixation on a photoreceptor is generated.

Another example of the method of inhibiting image unevenness includes a method of increasing the rotation rate of the lubricant application member, to reduce a difference in amount of lubricant between the background portion and the image portion, from "C1−B1" to "C3−B3", as shown in the graph of FIG. 14C. With this method, a difference in amount of lubricant is within the allowable width W, and the image unevenness is not generated. In this case, the amount of lubricant on the image carrier exceeds the threshold Th, and the toner fixation on a photoreceptor is not generated.

The image forming apparatuses disclosed in JP 2009-69582 A and JP 2010-169793 A inhibit the image unevenness using such a method. More specifically, the image forming apparatus disclosed in JP 2009-69582 A divides an area on the image carrier into a plurality of regions, calculates toner consumption on the image carrier, for each region, and applies lubricant when the toner consumption has a value not less than a predetermined threshold in any region. Similarly, the image forming apparatus disclosed in JP 2010-169793 A divides an image area into regions in a main scanning direction, detects toner consumption in each region, and increases an amount of the lubricant applied, when the toner consumption has a value not less than a certain level, in some of the regions.

However, even if the toner consumption has a value not less than the certain level, unevenness in application may be not generated without increasing the amount of the lubricant applied, depending on a relationship with peripheral regions. In this case, the lubricant is wasted.

SUMMARY OF THE INVENTION

The present disclosure has been made to solve the abovementioned problems, and according to one aspect, it is an object of the present invention to provide an image forming apparatus for reducing lubricant consumption while inhibiting image unevenness caused by a difference in amount of lubricant on an image carrier. According to another aspect, it is an object of the present invention to provide a control method with which lubricant consumption can be reduced, while inhibiting image unevenness caused by a difference in amount of lubricant on an image carrier.

To achieve at least one of the abovementioned objects, according to an aspect, an image forming apparatus reflecting one aspect of the present invention comprises: a rotatable image carrier; an image forming unit configured to form an electrostatic latent image on the image carrier based on information defining at least one of a toner region and a non-toner region; a development unit configured to develop the electrostatic latent image formed on the image carrier, as a toner image; a cleaning unit configured to remove toner remaining on the image carrier, after transfer of the toner image; an application unit configured to apply lubricant on the image carrier; and a hardware processor configured to control an amount of the lubricant applied, said hardware processor configured to: calculate a ratio of a toner region, for each of regions obtained by dividing a surface of the image carrier in a direction perpendicular to a rotation direction of the image carrier, based on at least one of the information input for a certain period in the past, and the information input for a certain period in the future which is expected from reserved jobs in the image forming apparatus; and control the amount of the lubricant applied according to a difference between a maximum value and a minimum value of the ratio calculated for the respective regions on the surface of the image carrier.

When the difference is larger, the hardware processor preferably increases the amount of the lubricant applied.

When the difference is less than a predetermined value, the hardware processor preferably controls the amount of the lubricant applied, according to a maximum value of the ratio calculated for the respective regions on the surface of the image carrier.

The hardware processor preferably controls the amount of the lubricant applied timely during a predetermined period including an image forming time of the image forming apparatus.

The application unit preferably includes a solid lubricant, and a rotation member configured to make contact with the solid lubricant and the image carrier. The rotation member preferably rotates to scrape out lubricant from the solid lubricant, and applies the lubricant over the image carrier. The hardware processor preferably controls a rotation amount of the rotation member to control the amount of the lubricant applied.

To achieve at least one of the abovementioned objects, according to an aspect, a control method in an image forming apparatus including a rotatable image carrier, an image forming unit configured to form an electrostatic latent image on the image carrier based on information defining at least one of a toner region and a non-toner region, a development unit configured to develop the electrostatic latent image formed on the image carrier, as a toner image, a cleaning unit configured to remove toner remaining on the image carrier, after transfer of the toner image, and an application unit configured to apply lubricant on the image carrier, reflecting one aspect of the present invention comprises the steps of: calculating a ratio of a toner region, for each of regions obtained by dividing a surface of the image carrier in a direction perpendicular to a rotation direction of the image carrier, based on at least one of the information input for a certain period in the past, and the information input for a certain period in the future which is expected from reserved jobs in the image forming apparatus; and controlling an amount of the lubricant applied according to a difference between a maximum value and a minimum value of the ratio calculated for the respective regions on the surface of the image carrier.

To achieve at least one of the abovementioned objects, according to an aspect, a non-transitory computer-readable recording medium reflecting one aspect of the present invention records a program for causing a computer in an image forming apparatus to perform the control method described above.

The program preferably causes the computer to further execute the step of: increasing the amount of the lubricant applied, when the difference is larger.

The program preferably causes the computer to further execute the step of: controlling the amount of the lubricant applied, according to a maximum value of the ratio calculated for the respective regions on the surface of the image carrier, when the difference is less than a predetermined value.

The program preferably causes the computer to further execute the step of: controlling the amount of the lubricant applied timely during a predetermined period including an image forming time of the image forming apparatus.

To achieve at least one of the abovementioned objects, according to an aspect, an image forming apparatus reflecting one aspect of the present invention executes a program recorded in the recording medium described above, wherein an application unit includes a solid lubricant, and a rotation member making contact with the solid lubricant and the image carrier, and the rotation member rotates to apply lubricant scraped out from the solid lubricant over the image carrier, wherein the program causes the computer to further execute the step of: controlling a rotation amount of the rotation member to control an amount of the lubricant applied.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 5 is a conceptual schematic diagram illustrating a method of calculating the ratio of an image portion based on written information;

DESCRIPTION OF THE PREFERRED EMBODIMENTS

Hereinafter, each embodiment of the present invention will be described with reference to the drawings. However, the scope of the invention is not limited to the illustrated examples. In the following description, the same parts and components are denoted by the same reference signs. The same parts and components are also indicated by the same names and functions. Therefore, detailed description thereof sill not be repeated. Note that, the embodiments and modifications thereof described below may be selectively combined appropriately.

The above and other objects, features, phases, and advantages of the present invention will be apparent from the following detailed description of the present invention which is understood with reference to the appended drawings.

First Embodiment

[Image Forming Apparatus 100]

Figure 1:
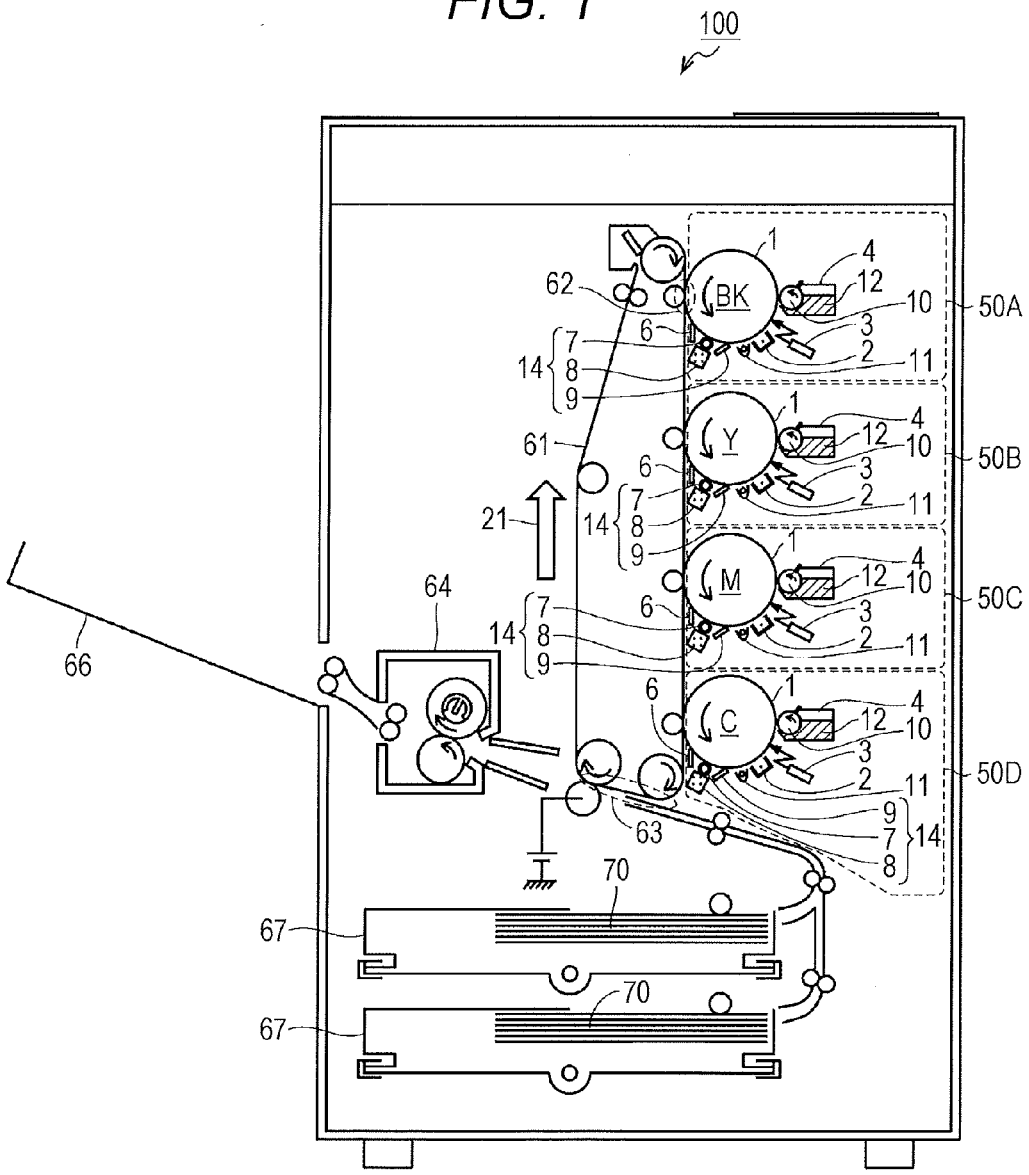
FIG. 1 is an exemplary diagram illustrating an internal configuration of an image forming apparatus.
Figure 2:
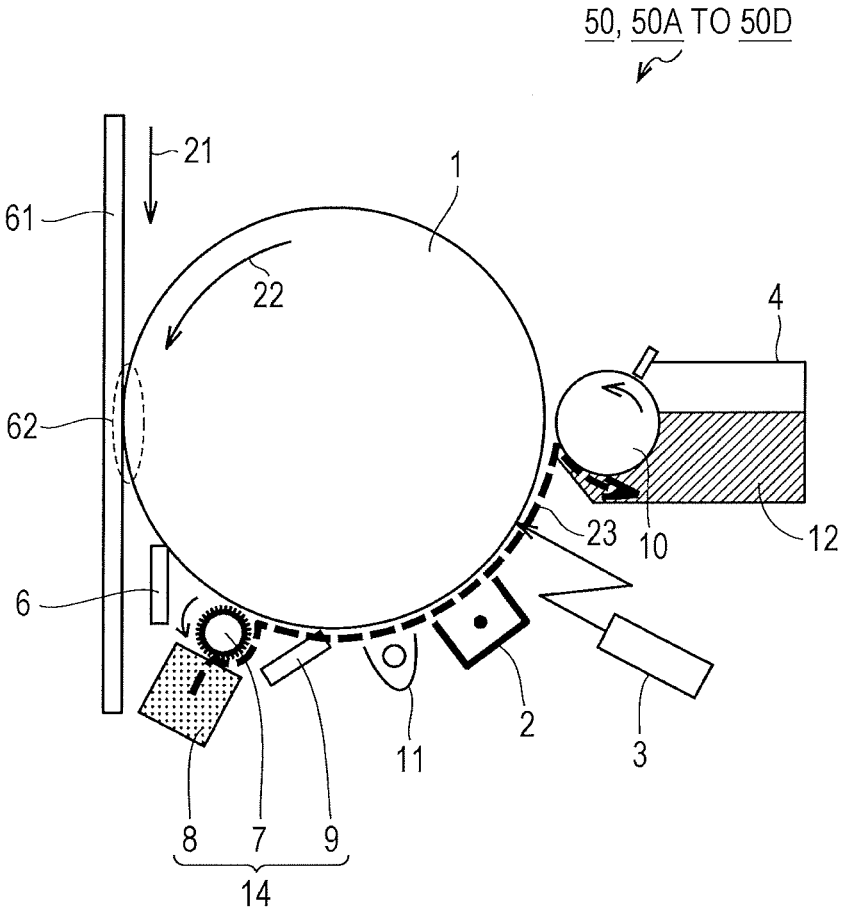
FIG. 2 is an exemplary diagram illustrating an internal configuration of an image forming unit.

With reference to FIGS. 1 and 2, a configuration of an image forming apparatus 100 according to a first embodiment will be described. FIG. 1 is an exemplary diagram illustrating an internal configuration of the image forming apparatus 100. FIG. 2 is an exemplary diagram illustrating an internal configuration of an image forming unit 50.

As illustrated in FIG. 1, the image forming apparatus 100 includes image forming units 50A to 50D, an intermediate transfer belt 61, a primary transfer unit 62, a secondary transfer unit 63, a fuser 64, a tray 66, and cassettes 67.

The image forming unit 50A forms a black (BK) toner image. The image forming unit 50B forms a yellow (Y) toner image. The image forming unit 50C forms a magenta (M) toner image. The image forming unit 50D forms a cyan (C) toner image. The image forming units 50A to 50D are sequentially disposed along a rotation direction of the intermediate transfer belt 61 (direction indicated by an arrow 21).

Hereinafter, the image forming units 50A to 50D are collectively called "image forming unit 50". As illustrated in FIG. 2, the image forming unit 50 includes an image carrier 1 represented as a photoreceptor, a charging device 2, an exposure device 3, a development device 4, a cleaning unit 6, an eraser lamp 11, and a lubricant application mechanism 14.

The image carrier 1 has a cylindrical shape, and on a surface of the cylindrical shape, a photoreceptor layer (not illustrated) is formed. The image carrier 1 rotates in a direction indicated by an arrow 22 in FIG. 2. On the outer periphery of the image carrier 1, the charging device 2, the exposure device 3, the development device 4, the cleaning unit 6, the eraser lamp 11, and the lubricant application mechanism 14 are sequentially disposed along the rotation direction of the image carrier 1.

The charging device 2 uniformly charges the surface of the image carrier 1 to a predetermined potential. Typically, the charging device 2 negatively charges the surface of the image carrier 1.

As an image forming unit, the exposure device 3 forms an electrostatic latent image on an image carrier 1, based on information (below-mentioned written information 122) defining at least one of a toner region and a non-toner region. The toner is adhered to the toner region during a development by the development device 4, and the toner is not adhered to the non-toner region during the development. More specifically, the exposure device 3 irradiates the surface of the image carrier 1 with light to reduce a charging level in an irradiated area, and forms the electrostatic latent image on the image carrier 1 according to an input image.

The development device 4 includes a developer carrier 10. In the developer carrier 10, developer 12 including a toner and a carrier is applied to the surface thereof, and develops the electrostatic latent image formed on the image carrier 1 as a toner image. In a development process, a development bias voltage is applied to the developer carrier 10 from a power supply 109 (see FIG. 9). The toner included in the developer 12 adheres to the electrostatic latent image on the image carrier 1, due to an electric field generated by potential of the electrostatic latent image on the image carrier 1. Therefore, the toner image is developed on the image carrier 1 according to the electrostatic latent image.

The intermediate transfer belt 61 is formed to face the image carrier 1, and rotates in a direction indicated by an arrow 21 while making contact with the image carrier 1. The toner image formed on the image carrier 1 is primarily transferred to the intermediate transfer belt 61, in the primary transfer unit 62 as a contact portion between the image carrier 1 and the intermediate transfer belt 61.

Figure 9:
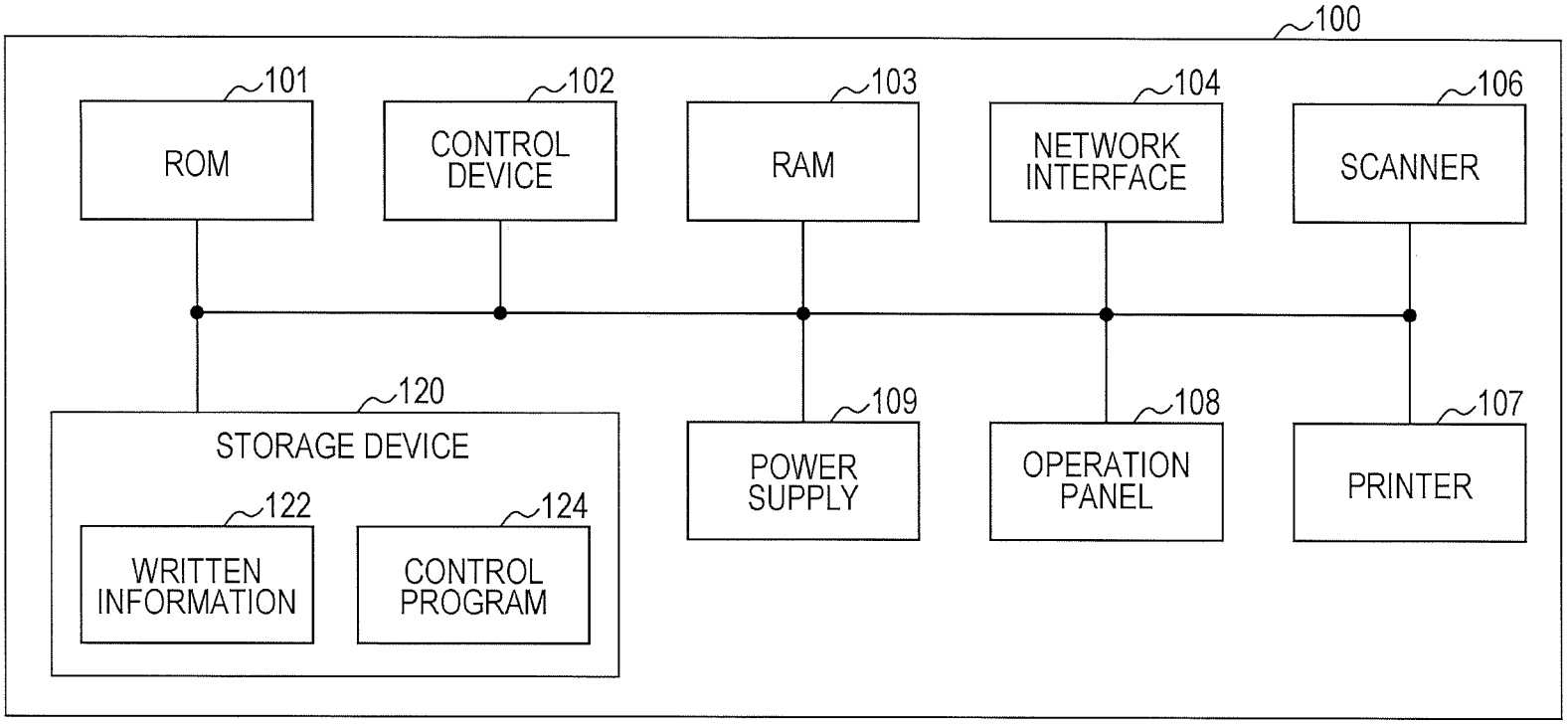
FIG. 9 is a block diagram illustrating a main hardware configuration of the image forming apparatus.

In a primary transfer process, a transfer bias voltage is applied to the intermediate transfer belt 61 from the power supply 109 (see FIG. 9). Therefore, an electric field is formed in the primary transfer unit 62. Thus, the toner image on the image carrier 1 is electrostatically adsorbed on the intermediate transfer belt 61, and transferred to the intermediate transfer belt 61.

At this time, the black (BK) toner image, the yellow (Y) toner image, the magenta (M) toner image, and the cyan (C) toner image are sequentially overlaid, and transferred to the intermediate transfer belt 61. Therefore, a color toner image is formed on the intermediate transfer belt 61.

When the toner image is transferred to the intermediate transfer belt 61, the cleaning unit 6 removes toner remaining on the image carrier 1, and the image forming unit 50 prepares for next image formation. In one example, the cleaning unit 6 is a flat cleaning blade made of an elastic material. For example, a cleaning method employs a blade cleaning method by which the cleaning blade being brought into contact with the image carrier 1 removes toner remaining on the image carrier 1.

On the downstream side (side indicated by arrow 22) of the cleaning unit 6, the lubricant application mechanism 14 (application unit) is provided for applying lubricant to the image carrier 1. The lubricant application mechanism 14 includes a lubricant application member 7, a solid lubricant 8, and a lubricant fixing member 9. The lubricant application mechanism 14 rotates the lubricant application member 7 to scrape out lubricant from the solid lubricant 8, and applies the lubricant to the surface of the image carrier 1. The lubricant application mechanism 14 will be described in detail later.

If necessary, between the lubricant application mechanism 14 and the charging device 2, the eraser lamp 11 is provided for erasing the electrostatic latent image. Thus, the electrostatic latent image is completely erased before next image formation, and a next image is clearly formed.

The toner image transferred to the intermediate transfer belt 61 is sent to the secondary transfer unit 63. In a secondary transfer process, the toner image on the intermediate transfer belt 61 is transferred to an object 70 on which printing is to be performed, by electrostatic adsorption of an electric field. The object 70 is fed from the cassette 67. After the toner image is transferred to the object 70, toner remaining on the intermediate transfer belt 61 are removed, and next primary transfer is performed. The object 70 on which the toner image has been transferred is transferred to the fuser 64. The image forming unit 50 fuses the toner image on the object 70, and the toner image is fixed on the object 70. Then, the object 70 is output into the tray 66.

Note that, an example of the image forming apparatus 100 configured as a color printer is illustrated in FIG. 1, but the image forming apparatus 100 may be configured to form a monochromatic image. That is, the image forming apparatus 100 is not limited to the color printer, and for example, may be a monochrome printer. Alternatively, the image forming apparatus 100 may be a combination device of a monochrome printer, color printer, and fax machine (so called multi-functional peripheral: MFP).

In addition, the intermediate transfer member 5 may be omitted. In this configuration, the image forming apparatus 100 directly transfers the toner image from the image carrier 1 to a recording medium. Additionally, electrophotographic processes conventionally used can be combined to an arbitrary configuration of the image forming apparatus 100, according to an object of the image forming apparatus 100.

[Developer 12]

A description will be continuously made of the developer 12 with reference to FIG. 2. The developer 12 includes the toner, and the carrier for charging the toner.

The toner is not particularly limited in kind. Known and commonly used toner is employed for the toner. In one example, the toner includes a colorant in a binder resin. Alternatively, the toner may include a charge control agent, mold release, or the like, when needed. Alternatively, the toner may include an additive. The toner has an arbitrary particle size, but the particle size is preferably approximately 3 to 15 μm.

The carrier is not particularly limited in kind. Known and commonly used carrier is employed for the carrier. For example, the carrier includes a binder carrier, a coated carrier, and the like. The carrier has an arbitrary particle size, but the particle size is preferably approximately 15 to 100 μm.

[Lubricant Application Mechanism 14]

A description will be continuously made of the lubricant application mechanism 14 with reference to FIG. 2. The lubricant application mechanism 14 includes the lubricant application member 7, the solid lubricant 8, and the lubricant fixing member 9.

The solid lubricant 8 is applied to the surface of the image carrier 1 to reduce surface energy thereof, and reduce adhesion between the toner and the image carrier 1. For the solid lubricant 8, for example, a fatty acid metal salt and a fluorine-based resin are employed. The fatty acid metal salt and the fluorine-based resin may be mixed with each other to be used for the solid lubricant 8, or either one of the fatty acid metal salt and the fluorine-based resin may be used for the solid lubricant 8.

Preferably, the solid lubricant 8 includes the fatty acid metal salt. The fatty acid metal salt preferably includes an aliphatic acid being a linear hydrocarbon. The hydrocarbon includes myristic acid, palmitic acid, stearic acid, oleic acid, or the like. Among them, the stearic acid is further preferably employed.

The metal of the fatty acid metal salt includes lithium, magnesium, calcium, strontium, zinc, cadmium, aluminum, cerium, titanium, iron, or the like. Combination of the aliphatic acid and the metal of the fatty acid metal salt preferably includes zinc stearate, magnesium stearate, aluminum stearate, iron stearic acid, or the like, and further particularly preferably includes zinc stearate.

The solid lubricant 8 is molded by melting the above-mentioned material, into a shape suitable for scraping, and used as the solid lubricant. Alternatively, the solid lubricant 8 is formed by compression molding of particles of the above-mentioned material, into a shape suitable for scraping, and used as the solid lubricant.

The lubricant application member 7 includes for example a brush or a sponge. Among them, the brush is suitably employed. The lubricant application member 7 is provided to make contact with both of the image carrier 1 and the solid lubricant 8, rotates to scrape out lubricant from the solid lubricant 8, and applies the lubricant to the image carrier 1. An amount of the lubricant applied is controlled by controlling the rotation amount of the lubricant application member 7.

A rotation direction of the lubricant application member 7 may be a with direction (where surfaces in a contact portion move in the same direction), or a counter direction (where surfaces in a contact portion move in the opposite directions), relative to the image carrier 1. The counter direction is preferably employed to spread and apply a larger amount of the lubricant over the image carrier 1.

The rotation speed of the lubricant application member 7 is controlled by changing a rotation rate of a motor connected to the lubricant application member 7. When the rotation rate of the motor is increased, the amount of the lubricant applied is increased, and when the rotation rate of the motor is reduced, the amount of the lubricant applied is reduced. A method of controlling the lubricant application member 7 will be described in detail later.

The lubricant fixing member 9 is provided on the side indicated by the arrow 22, adjacent to the lubricant application member 7. The lubricant fixing member 9 further spreads and applies lubricant applied to the image carrier 1, over the image carrier 1, and removes lubricant excessively applied. A material of the lubricant fixing member 9 employs for example a flat blade made of an elastic material, similarly to the cleaning unit 6. Note that, the lubricant fixing member 9 is not an essential configuration, and the lubricant application mechanism 14 preferably includes at least the lubricant application member 7 and the solid lubricant 8.

[Method of Controlling Amount of the Lubricant Applied]

Figure 3:
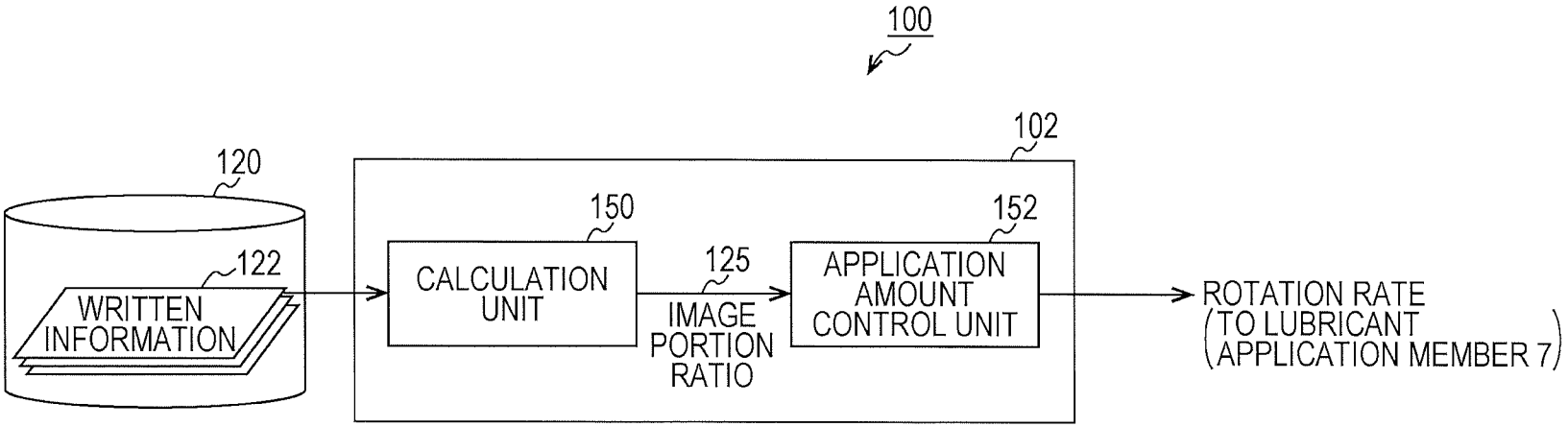
FIG. 3 is an exemplary block diagram illustrating a functional configuration of an image forming apparatus.

A method of controlling the amount of the lubricant applied to the image carrier 1 will be described with reference to FIGS. 3 to 7. FIG. 3 is an exemplary block diagram illustrating a functional configuration of the image forming apparatus 100.

As illustrated in FIG. 3, the image forming apparatus 100 includes a control device 102 and a storage device 120. The control device 102 includes, as the functional configuration, a calculation unit 150 and an application amount control unit 152. The calculation unit 150 and the application amount control unit 152 will be described sequentially below.

(Calculation Unit 150)

The calculation unit 150 calculates a ratio of the toner region (hereinafter, also referred to as "image portion ratio"), for each of regions obtained by dividing the surface of the image carrier 1 in a direction perpendicular to the rotation direction of the image carrier 1 (hereinafter, also referred to as "main scanning direction"). Note that, the main scanning direction does not need to be strictly perpendicular to the rotation direction of the image carrier 1, and is preferably substantially perpendicular to the rotation direction.

Figure 4:
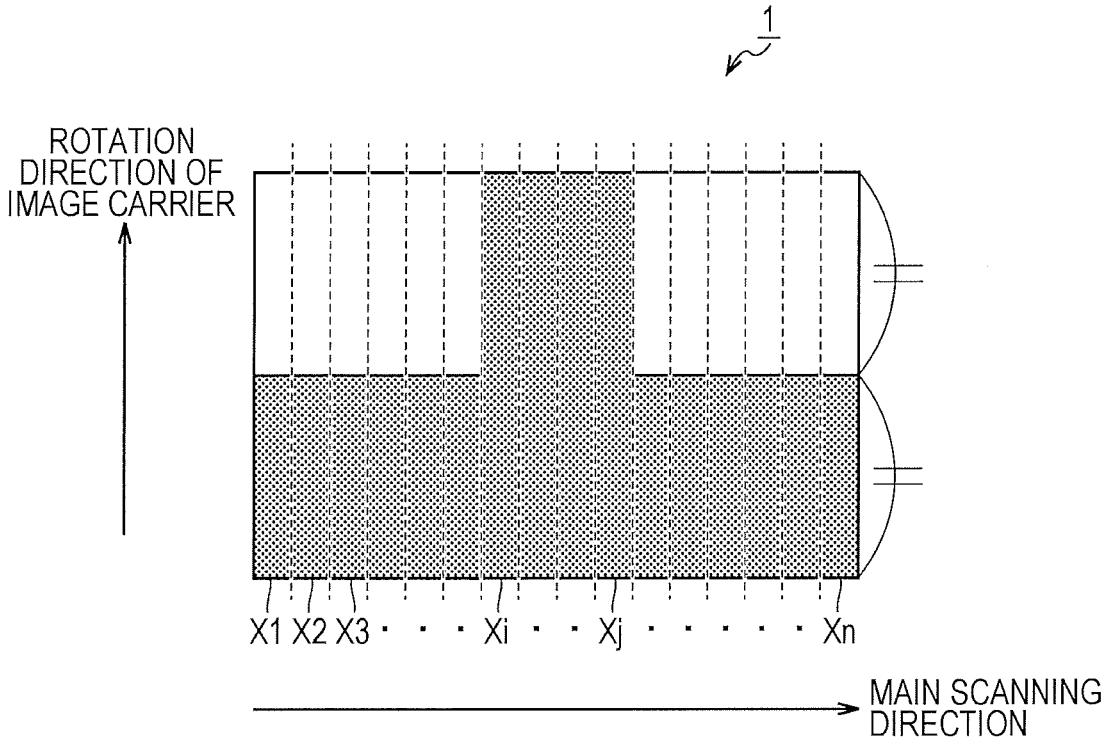
FIG. 4 is an exemplary diagram illustrating a method of dividing a surface of an image carrier surface.

A method of calculating the image portion ratio by the calculation unit 150, will be described with reference to FIGS. 4 and 5. FIG. 4 is an exemplary diagram illustrating a method of dividing the surface of the image carrier 1. FIG. 5 is a conceptual schematic diagram illustrating the method of calculating the image portion ratio based on the written information 122.

As illustrated in FIG. 4, the surface of the image carrier 1 is divided into a predetermined division number in the main scanning direction. FIG. 4 illustrates an example of the surface of the image carrier 1 divided into regions X1 to Xn. The division number of the regions X1 to Xn can be appropriately set according to a degree of subdivision. Preferably, the surface is divided into the regions X1 to Xn to have a minimum unit of writing the electrostatic latent image. That is, each of the regions X1 to Xn has a width corresponding to one pixel width, in the main scanning direction. Thus, remarkable effect of inhibiting the image unevenness is provided.

Whenever the image forming apparatus 100 forms an image, the storage device 120 stores the written information 122 of an electrostatic latent image according to the image. The written information 122 represents information defining the toner region and the non-toner region. In an example of FIG. 5, the toner region, of the image carrier 1, is defined by "1", and the non-toner region, of the image carrier 1, is defined by "0". Note that, the written information 122 does not need to define both of the toner region and the non-toner region, and either of them is preferably defined. This is because when either of the toner region and the non-toner region is determined, the other can be determined.

According to one aspect, the calculation unit 150 calculates the image portion ratio of the toner region, for each of the regions X1 to Xn, based on the written information 122 input for a certain period in the past. The image portion ratio represents a ratio of an area of the toner region to an area of each of the regions X1 to Xn. In an example of FIG. 5, the regions Xi to Xj have an image portion ratio of "100%", the other regions have an image portion ratio of "50%". The calculation unit 150 outputs the image portion ratio 125 calculated from the written information 122, to the application amount control unit 152.

A length of the certain period in the past which is reference for calculation of the image portion ratio can be appropriately set based on the circumferential length of the image carrier 1 of the image forming apparatus 100 or reduction speed of lubricant on the image carrier caused by toner. Preferably, the length of the certain period in the past is set to a time required for several revolutions to several hundred revolutions of the image carrier 1.

According to another aspect, the calculation unit 150 calculates the image portion ratio 125, based on the written information 122 input for a certain period in the future which is expected from reserved jobs in the image forming apparatus 100. For example, the reserved jobs include print jobs. When the print jobs are accumulated in the image forming apparatus 100, the calculation unit 150 calculates the image portion ratio 125 based on the written information 122 according to image patterns to be printed.

(Application Amount Control Unit 152)

The application amount control unit 152 controls the amount of the lubricant applied to the image carrier 1, based on the image portion ratio 125 calculated by the calculation unit 150. In one example, the application amount control unit 152 changes the amount of the lubricant applied, by controlling the rotation amount (rotation speed) of the lubricant application member 7 (see FIG. 2).

Figure 6A:
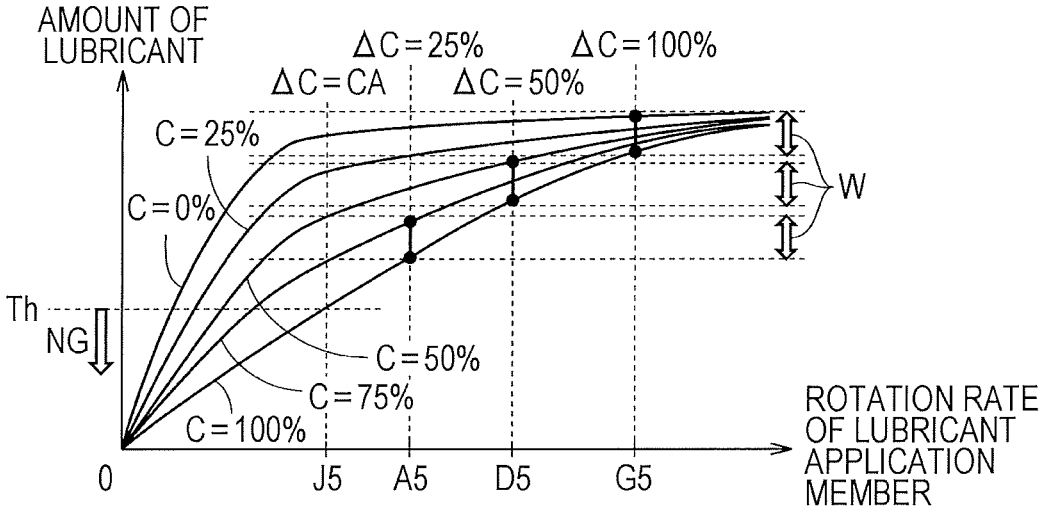
FIGS. 6A and 6B are schematic diagrams illustrating a method of controlling the amount of the lubricant applied, which is performed when various image patterns are input.
Figure 6B:
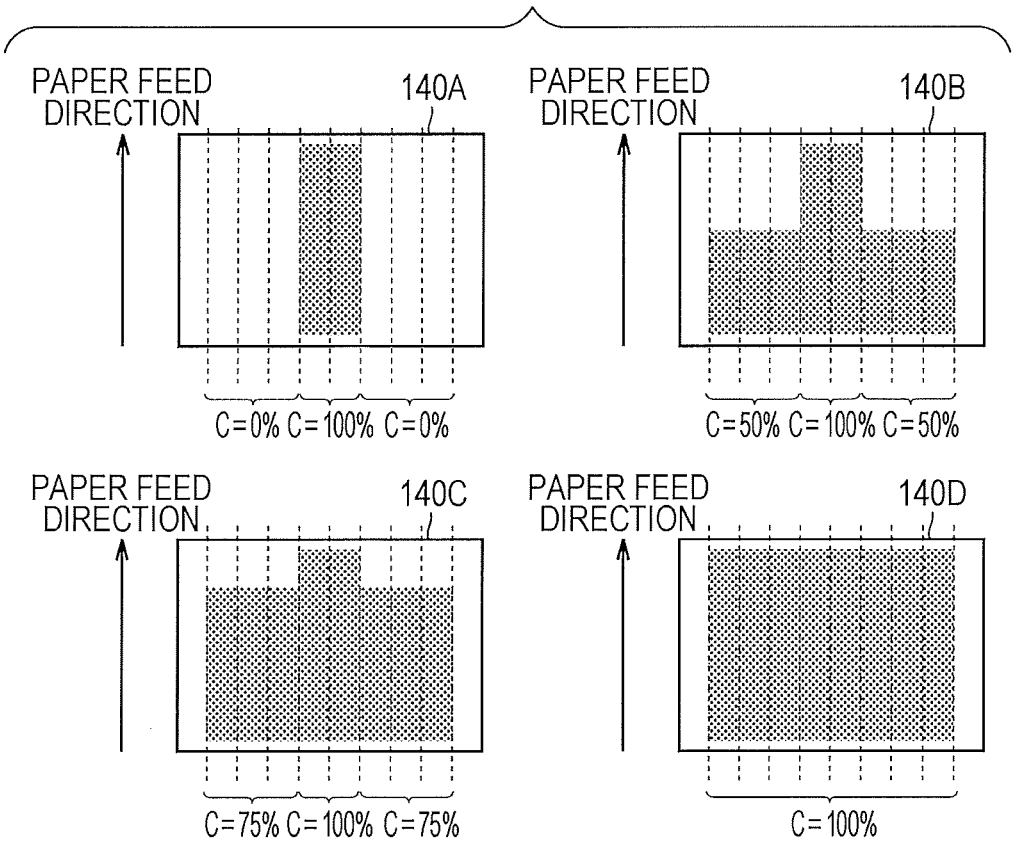

A method of controlling the amount of the lubricant applied which is performed by the application amount control unit 152 will be described below, with reference to FIGS. 6A and 6B. FIGS. 6A and 6B are schematic diagrams illustrating the method of controlling the amount of the lubricant applied, which is performed when various image patterns 140A to 140D are input.

A graph of FIG. 6A illustrates a relationship between the rotation amount of the lubricant application member 7 and the amount of lubricant applied to the image carrier 1, when the image portion ratio C is "0%", "25%", "50%", "75%", and "100%".

As illustrated in the graph of FIG. 6A, when the lubricant application member 7 has an identical rotation rate, the higher the image portion ratio is, the less the amount of lubricant on the image carrier 1 is. Furthermore, when the rotation rate of the lubricant application member 7 is small, there is little difference in amount of the lubricant applied, even if the image portion ratio is different. This is because the amount of the lubricant applied is small. When the rotation rate of the lubricant application member 7 is increased, a significant difference in application amount is shown according to the image portion ratio. When the rotation rate of the lubricant application member 7 is further increased, the application amount reaches an upper limit, and even if the image portion ratio is different, there is no difference in application amount.

The application amount control unit 152 controls the amount of the lubricant applied to the image carrier 1, according to a difference ΔC between a maximum value Cmax and a minimum value Cmin of image portion ratio 125 (see FIG. 5) calculated for the regions X1 to Xn of the image carrier 1 (see FIG. 5). More specifically, the application amount control unit 152 controls the rotation of the lubricant application member 7 so that the difference ΔC is within the allowable width W not causing the image unevenness and further the rotation amount is minimized.

For example, let us assume that the image pattern 140A as illustrated in a specific example of FIG. 6B is continuously printed. In this case, regions at the center of the image have an image portion ratio C of "100%", and the other regions have an image portion ratio C of "0%". As a result, the difference ΔC between the maximum value Cmax and the minimum value Cmin of the image portion ratio is "100% (=100%−0%)". In this situation, a difference between a curve representing an image portion ratio C of "0%" and a curve representing an image portion ratio C of "100%" is a difference in amount of lubricant on the image carrier 1, in the graph of FIG. 6A. The application amount control unit 152 sets the rotation rate of the lubricant application member 7 to "G5" so that the difference is within the allowable width W. Thus, the application amount control unit 152 can reduce lubricant consumption without causing the image unevenness.

In another example, let us assume that the image pattern 140B is continuously printed. In this case, regions at the center of the image have an image portion ratio C of "100%", and the other regions have an image portion ratio C of "50%". As a result, the difference ΔC between the maximum value Cmax and the minimum value Cmin of the image portion ratio is "50% (=100%−50%)". In this situation, a difference between a curve representing an image portion ratio C of "50%" and a curve representing an image portion ratio C of "100%" is a difference in amount of lubricant on the image carrier 1, in the graph of FIG. 6A. The application amount control unit 152 sets the rotation rate of the lubricant application member 7 to "D5" so that the difference is within the allowable width W. Thus, the application amount control unit 152 can reduce lubricant consumption without causing the image unevenness.

In still another example, let us assume that the image pattern 140C is continuously printed. In this case, regions at the center of the image have an image portion ratio C of "100%", and the other regions have an image portion ratio C of "75%". As a result, the difference ΔC between the maximum value Cmax and the minimum value Cmin of the image portion ratio is "25% (=100%−75%)". In this situation, a difference between a curve representing an image portion ratio C of "75%" and a curve representing an image portion ratio C of "100%" is a difference in amount of lubricant on the image carrier 1, in the graph of FIG. 6A. The application amount control unit 152 sets the rotation rate of the lubricant application member 7 to "A5" so that the difference is within the allowable width W. Thus, the application amount control unit 152 can reduce lubricant consumption without causing the image unevenness.

In still further another example, let us assume that the image pattern 140D is continuously printed. In this situation, the amount of toner at the cleaning unit 6 is uniform in the main scanning direction, so that there is no difference in amount of lubricant between the regions on the image carrier 1. That is, the difference ΔC between the maximum value Cmax and the minimum value Cmin of the image portion ratio is "0% (=100%−100%)". In this condition, even if the lubricant application member 7 is set to any rotation rate, the image unevenness is not caused, so that the rotation rate of the lubricant application member 7 is preferably reduced as much as possible. However, excessive reduction of the rotation rate of the lubricant application member 7 causes reduction of lubricant on the image carrier 1, and toner is fixed to the image carrier 1. Therefore, in order to inhibit fixation of toner onto the image carrier 1, the application amount control unit 152 sets the rotation rate of the lubricant application member 7 to "J5" so that the amount of lubricant exceeds a threshold Th being a boundary of generation of the toner fixation. Therefore, the application amount control unit 152 can reduce lubricant consumption, while preventing fixation of toner onto the image carrier 1.

Figure 7:
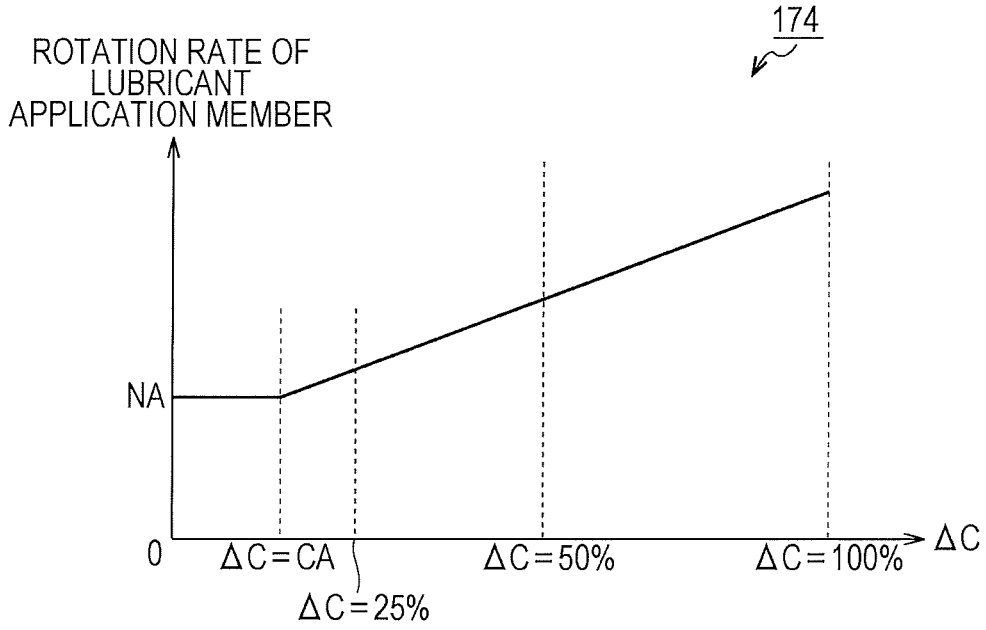
FIG. 7 is a graph illustrating a relationship between a difference between a maximum value and a minimum value of image portion ratio, and a rotation rate of a lubricant application member.

Therefore, when a difference ΔC between the maximum value Cmax and the minimum value Cmin of the image portion ratio is larger, the application amount control unit 152 increases the amount of the lubricant applied. FIG. 7 is a graph 174 illustrating a relationship between the difference ΔC and the rotation rate of the lubricant application member 7. As illustrated in FIG. 7, when the difference ΔC is not less than the predetermined value CA, the application amount control unit 152 increases the amount of the lubricant applied according to the difference ΔC. When the difference ΔC is less than the predetermined value CA, the application amount control unit 152 sets the rotation rate of the lubricant application member 7 to a rotation rate NA being the lowest rotation rate of the rotation rates at which fixation of toner onto the image carrier 1 is not caused.

Note that, in the above description, control of the rotation rate of the lubricant application member 7 has been exemplified, as the method of controlling the amount of the lubricant applied, but various known methods can be adopted as long as the amount of the lubricant applied can be changed. For example, a method of changing a force pressing the lubricant application member against the solid lubricant, a method of changing compression of the lubricant application member against the image carrier 1, or the like may be adopted.

[Control Structure of Image Forming Apparatus 100]

Figure 8:
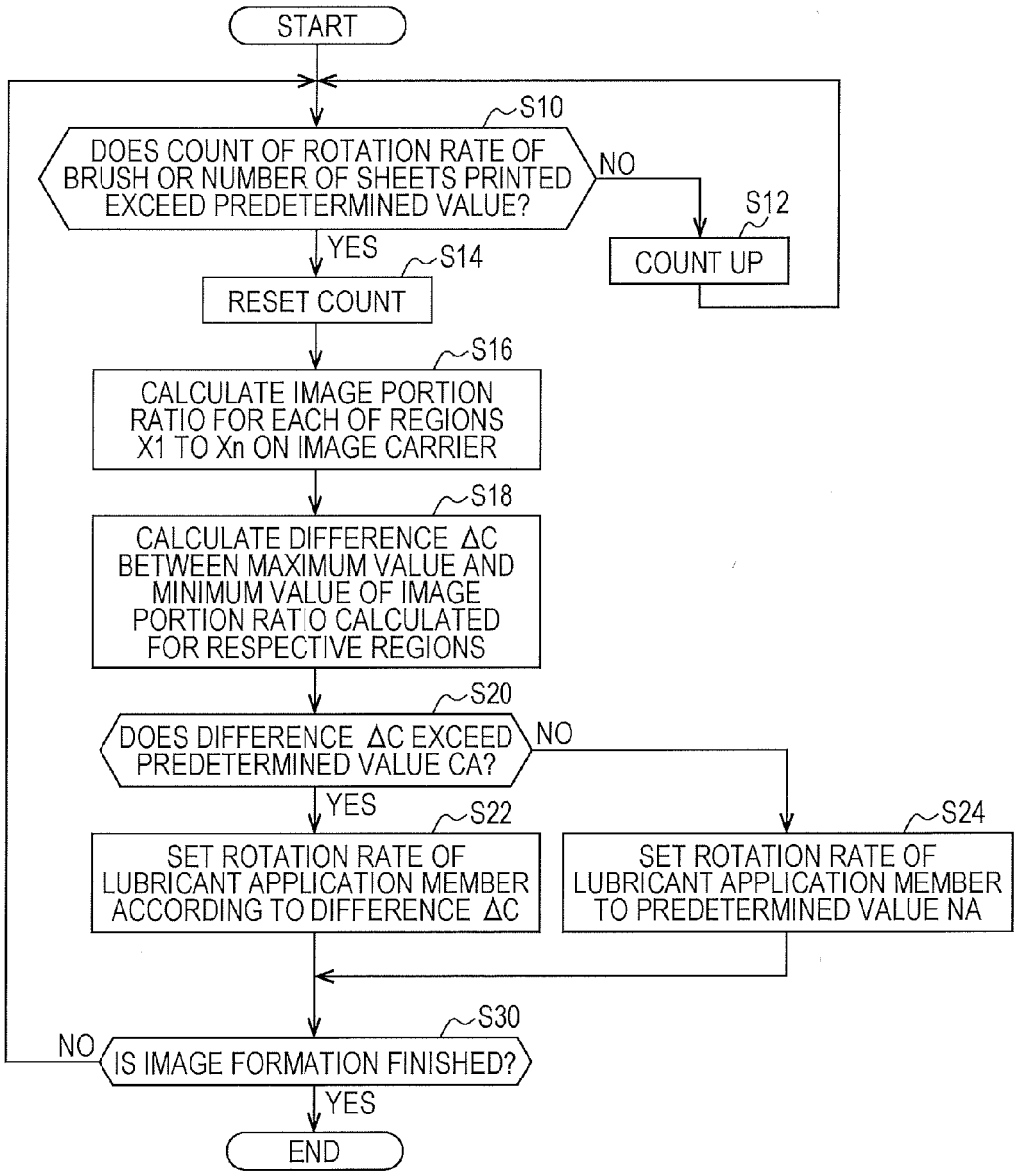
FIG. 8 is a flowchart illustrating part of processing performed by the image forming apparatus.

A control structure of the image forming apparatus 100 will be described with reference to FIG. 8. FIG. 8 is a flowchart illustrating part of processing performed by the image forming apparatus 100. Processing of FIG. 8 is achieved by executing a program by the control device 102 of the image forming apparatus 100. According to another aspect, whole or part of the processing may be performed by a circuit element or other hardware.

In step S10, the control device 102 determines whether the amount of the lubricant applied can be timely reset. According to an aspect, the control device 102 counts revolutions of the image carrier 1, and when the revolutions exceeds a predetermined value, the control device 102 determines that the amount of the lubricant applied can be timely reset. According to another aspect, the control device 102 counts the number of sheets printed, and when the number of sheets printed exceeds a predetermined value, the control device 102 determines that the amount of the lubricant applied can be timely reset.

A resetting period is preferably set to a sufficiently short time, compared to a time having a difference in amount of lubricant on the image carrier 1 depending on the image pattern. In one example, the period is set to a time required for one revolution to several hundred revolutions of the image carrier. When a count representing the revolutions of the image carrier 1 or the number of sheets printed exceeds a predetermined value (YES in step S10), the control device 102 determines that the amount of the lubricant applied can be timely reset, and switches the control to step S14. Otherwise (NO in step S10), the control device 102 switches the control to step S12.

In step S12, the control device 102 increments the count representing the revolutions of the image carrier 1 or the number of sheets printed.

In step S14, the control device 102 resets the count representing the revolutions of the image carrier 1 or the number of sheets printed. That is, the count is set to zero.

In step S16, the control device 102 serves as the calculation unit 150 (see FIG. 3) to divide the surface of the image carrier 1 in the main scanning direction into the regions X1 to Xn (see FIG. 4), and calculate the image portion ratio for each of the regions X1 to Xn. The calculated image portion ratio is, for example, sequentially stored in a storage unit of the image forming apparatus 100.

In step S18, the control device 102 serves as the calculation unit 150 to designate the maximum value Cmax and the minimum value Cmin from the calculated image portion ratio, and calculate the difference ΔC between the maximum value Cmax and the minimum value Cmin.

In step S20, the control device 102 determines whether the difference ΔC exceeds the predetermined value CA (see FIG. 7). When the difference ΔC is determined to exceed the predetermined value CA (YES in step S20), the control device 102 switches the control to step S22. Otherwise (NO in step S20), the control device 102 switches the control to step S24.

In step S22, the control device 102 serves as the application amount control unit 152 (see FIG. 3), and determines the rotation rate of the lubricant application member 7 according to the difference ΔC. More specifically, when the difference ΔC is larger, the control device 102 increases the rotation rate of the lubricant application member 7. When the difference ΔC is smaller, the control device 102 reduces the rotation rate of the lubricant application member 7.

In step S24, the control device 102 serves as the application amount control unit 152 to set the rotation rate of the lubricant application member 7, to the rotation rate NA being the lowest rotation rate of the rotation rates at which fixation of toner onto the image carrier 1 is not caused.

In step S30, the control device 102 determines whether the image formation is finished. When the image formation is determined to be finished (YES in step S30), the control device 102 finishes the control according to the present embodiment. Otherwise (NO in step S30), the control device 102 returns the control to step S10.

As described above, during image formation by the image forming apparatus 100, the control device 102 controls the amount of the lubricant applied. The amount of the lubricant applied is appropriately changed without stopping the processing of forming an image, and thus user's waiting time is reduced. Note that, change of the amount of the lubricant applied does not need to be performed during image formation, and may be performed before image formation (before performance of print job) or after image formation (after performance of print job). That is, control of the amount of the lubricant applied is preferably performed timely during a predetermined period including an image forming time.

[Hardware Configuration of Image Forming Apparatus 100]

An example of a hardware configuration of the image forming apparatus 100 will be described with reference to FIG. 9. FIG. 9 is a block diagram illustrating a main hardware configuration of the image forming apparatus 100. As illustrated in FIG. 9, the image forming apparatus 100 includes a read only memory (ROM) 101, the control device 102, a random access memory (RAM) 103, a network interface 104, a scanner 106, a printer 107, an operation panel 108, the power supply 109, and the storage device 120.

The ROM 101 stores control programs and the like performed in the image forming apparatus 100. The control device 102 executes various programs such as the control programs for the image forming apparatus 100, and controls the operation of the image forming apparatus 100. The control device 102 is a central processing unit (CPU), an integrated circuit (IC), or the like. The RAM 103 functions as a working memory, and temporarily stores various data required for performance of the control programs.

To the network interface 104, an antenna (not illustrated) or the like is connected. The image forming apparatus 100 transmits and receives data with another communication device through the antenna. The another communication device includes a mobile communication terminal such as a smartphone, or a server. The image forming apparatus 100 may be configured to download a control program 124 according to the present embodiment, from the server through the antenna.

The scanner 106 optically reads a document set to the image forming apparatus 100, and generates image data of the document.

The printer 107, for example, electrophotographically converts image data read by the scanner 106, or print data transmitted from the another communication device, to data for printing, and prints an image such as the document based on the data obtained after conversion.

The operation panel 108 is configured as a touch panel, and receives operation to the image forming apparatus 100 through touch operation. In one example, the operation panel 108 includes a display panel, and a touch sensor provided over the display panel. The operation panel 108 receives setting operation for the control program 124, printing instruction, or the like.

The power supply 109 supplies power to each device of the image forming apparatus 100, based on pressing of a power button (not illustrated) of the image forming apparatus 100.

The storage device 120 is a storage medium such as a hard disk or an external storage device. In one example, the storage device 120 stores the above-mentioned written information 122 (see FIG. 5), and the control program 124 for achieving the processing according to the present embodiment.

Note that, the control program 124 according to the present embodiment may be provided as a partial program incorporated into an arbitrary program, instead of as a single program. In this configuration, the processing according to the present embodiment is achieved in cooperation with the arbitrary program. Such a program not including some of modules is not excluded from the gist of the programs according to the present embodiment. Furthermore, part or all of functions provided by the control program 124 according to the present embodiment may be achieved by dedicated hardware. Still furthermore, the image forming apparatus 100 may be configured to have a mode such as so-called cloud service which achieves the processing according to the present embodiment by at least one server.

Figure 10:
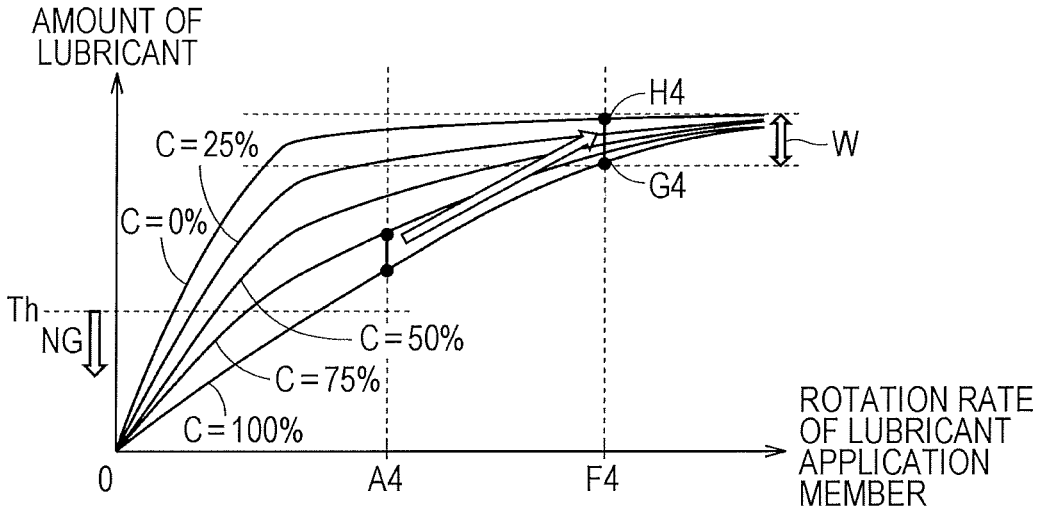
FIG. 10 is a graph illustrating a relationship between a rotation amount of the lubricant application member, and the amount of lubricant applied to the image carrier, when the image portion ratio is "0%", "25%", "50%", "75%", and "100%"

Advantages of the image forming apparatus 100 according to the present embodiment will be described with reference to FIG. 10, using an example of an image forming apparatus according to a comparison example. FIG. 10 is a graph illustrating a relationship between a rotation amount of the lubricant application member, and the amount of lubricant applied to the image carrier 1, when the image portion ratio C is "0%", "25%", "50%", "75%", and "100%".

When the maximum value of the image portion ratio exceeds the predetermined value, the image forming apparatus according to the comparison example increases the rotation rate of the lubricant application member 7. That is, the image forming apparatus uses only the maximum value to control the rotation rate of the lubricant application member 7, without using the minimum value of the image portion ratio. When a current rotation rate is set to "A4", and the image portion ratio is, for example, "100%", the image forming apparatus according to the comparison example increases the rotation rate from "A4" to "F4". However, when there is little difference in image portion ratio between a corresponding region and another region, the image unevenness is not caused at the rotation rate of "A4". For example, when another region has an image portion ratio of "75%", a difference in image portion ratio is "25% (=100%−75%)", and the image unevenness is not caused. In such a condition, the image forming apparatus according to the comparison example increases the rotation rate, and as a result, lubricant is wasted.

The image forming apparatus 100 according to the present embodiment controls the rotation rate of the lubricant application member 7, according to the difference between the maximum value and the minimum value of the image portion ratio of the respective regions of the image carrier 1, so that when the image unevenness is not caused, the rotation rate of the image carrier 1 is not increased. For example, when the maximum value of the image portion ratio is "100%", and the minimum value is "75%", the difference between the maximum value and the minimum value is "25% (=100%−75%)". The difference is within the allowable width W, and the image unevenness is not generated. As described above, the image forming apparatus 100 according to the present embodiment relatively controls the rotation rate of the lubricant application member 7, based on the image portion ratio of each region on the image carrier 1, and the lubricant consumption can be reduced while inhibiting the image unevenness.

Furthermore, when lubricant consumption increases, a pressing force of the lubricant application member 7 against the solid lubricant 8 is increased, and management of the amount of lubricant supplied is made difficult. The image forming apparatus 100 can reduce the lubricant consumption, and thus, such a problem can be solved.

Furthermore, when the amount of lubricant supplied increases, an amount of lubricant entering the development device 4 through a path, indicated by an arrow 23 of FIG. 2, is increased. Therefore, chargeability or fluidity of toner is changed, and fog or scattering of toner is caused. The image forming apparatus 100 can appropriately control the amount of lubricant supplied, and thus, such a problem can be solved.

Second Embodiment

The image forming apparatus 100 according to the first embodiment is configured so that when a difference ΔC between the maximum value Cmax and the minimum value Cmin of the image portion ratio of respective regions of the image carrier 1 is less than the predetermined value CA (see FIG. 7), the rotation rate of the lubricant application member 7 is maintained constant to the rotation rate NA (see FIG. 7), without causing the fixation of toner onto the image carrier 1. In contrast, an image forming apparatus 100 according to a second embodiment is configured so that when the difference ΔC is less than the predetermined value CA, the rotation rate of the image carrier 1 is reduced according to the maximum value Cmax of the image portion ratio. Therefore, lubricant consumption can be further reduced.

[Method of Controlling Amount of the Lubricant Applied]

Figure 11A:
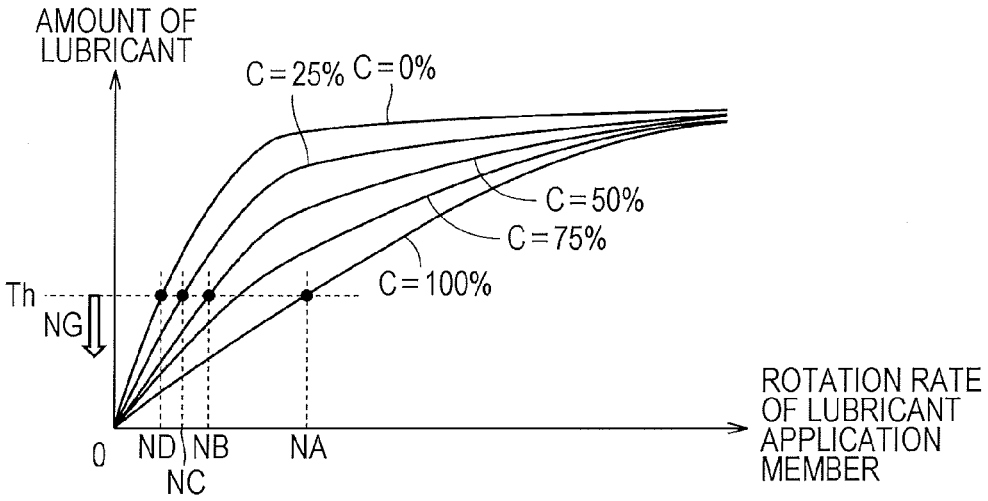
FIGS. 11A and 11B are schematic diagrams illustrating a method of controlling the amount of the lubricant applied, which is performed when various image patterns are input.
Figure 11B:
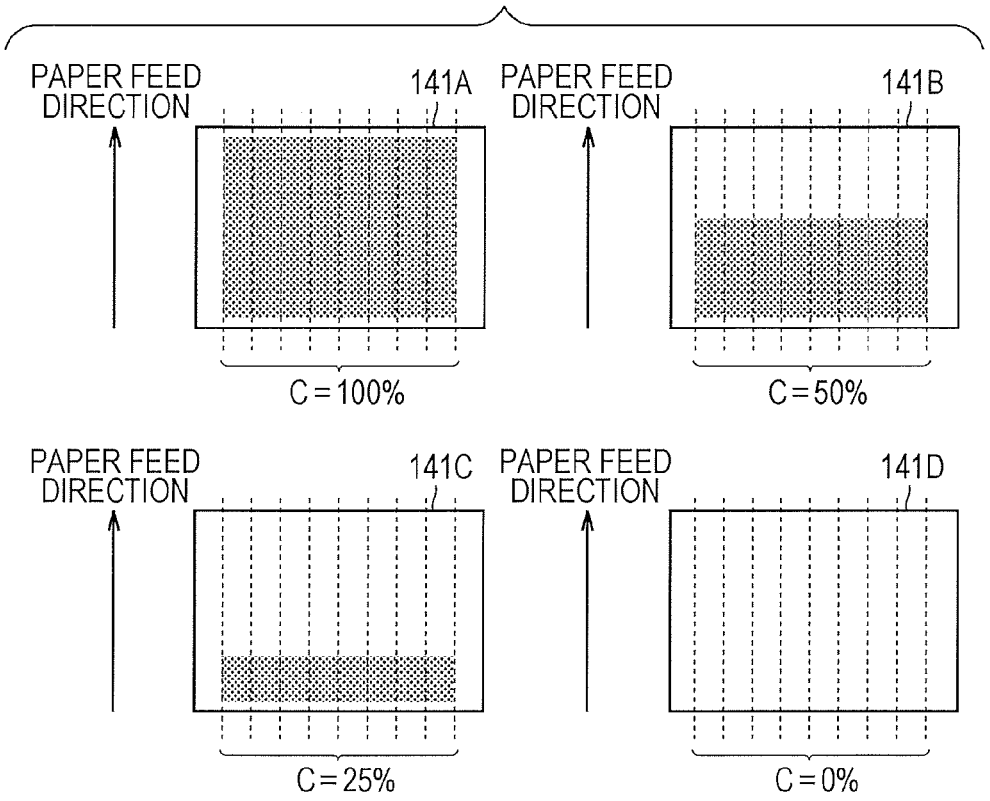
Figure 12:
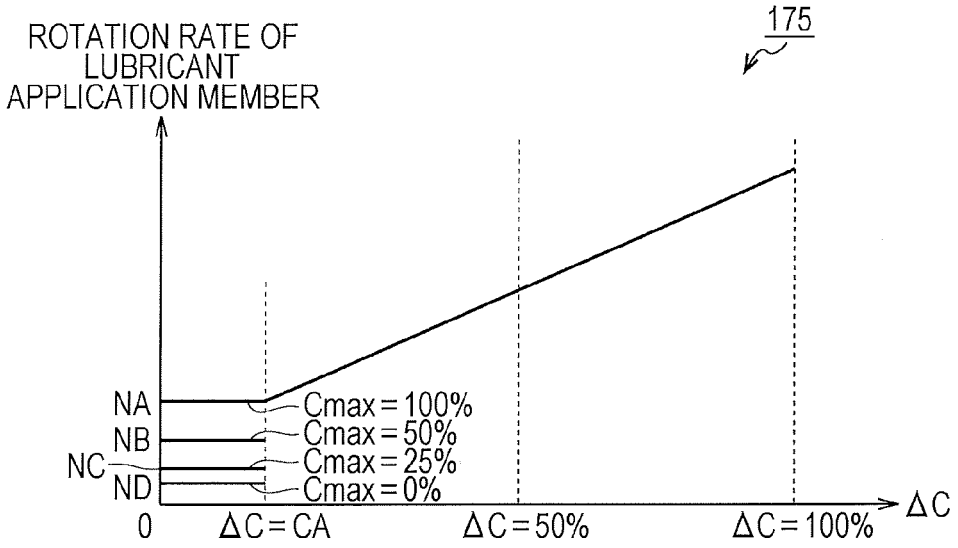
FIG. 12 is a graph illustrating a relationship between a difference between a maximum value and a minimum value of the image portion ratio, and a rotation rate of the lubricant application member.
Figure 13A:
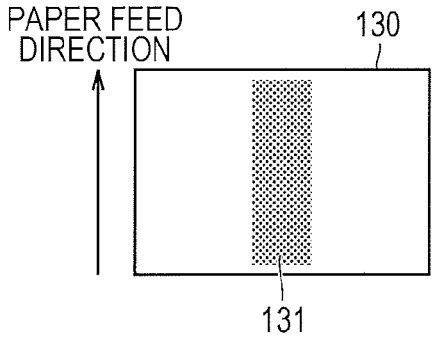
FIGS. 13A and 13B are exemplary diagrams illustrating image unevenness.
Figure 13B:
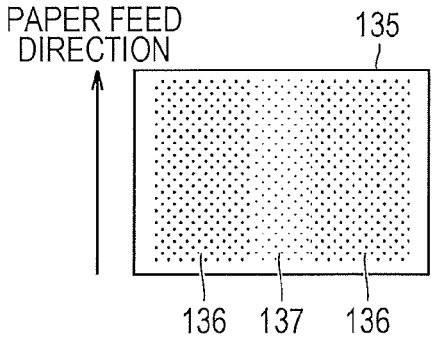
Figure 14A:
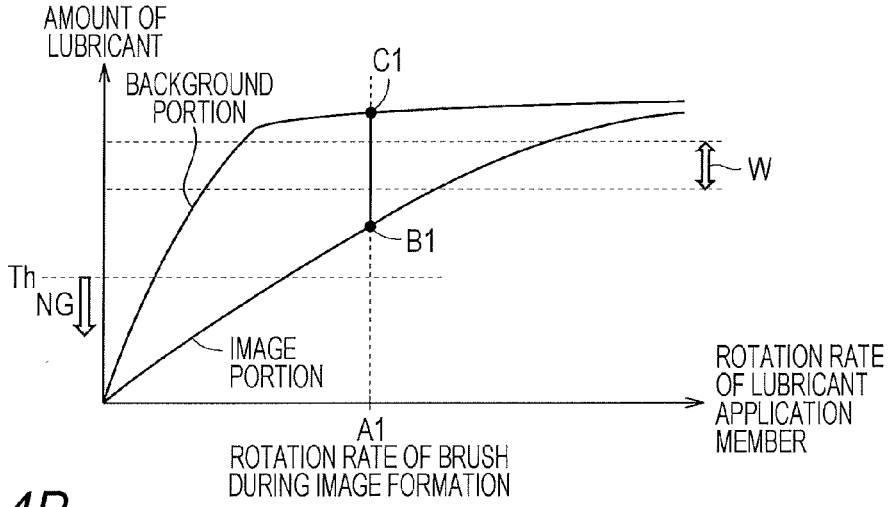
FIGS. 14A, 14B, and 14C are graphs each illustrating a relationship between a rotation rate of the lubricant application member and an amount of lubricant on the image carrier.
Figure 14B:
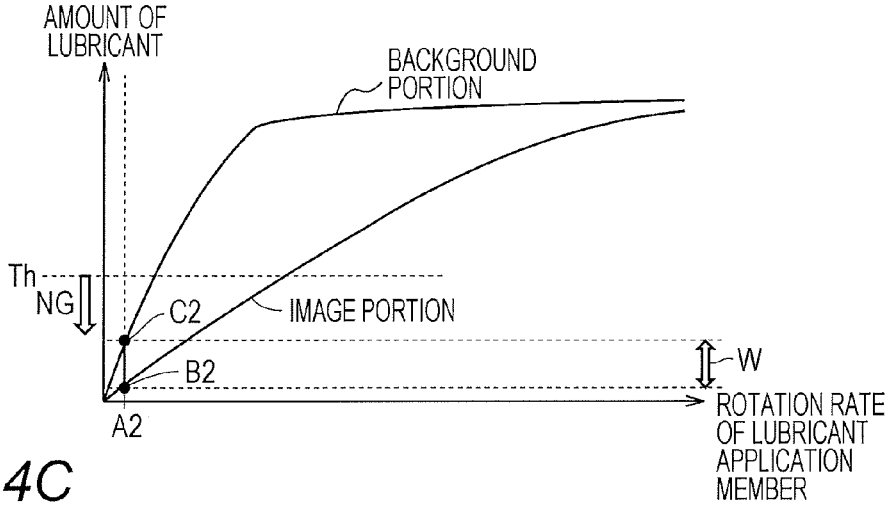
Figure 14C:
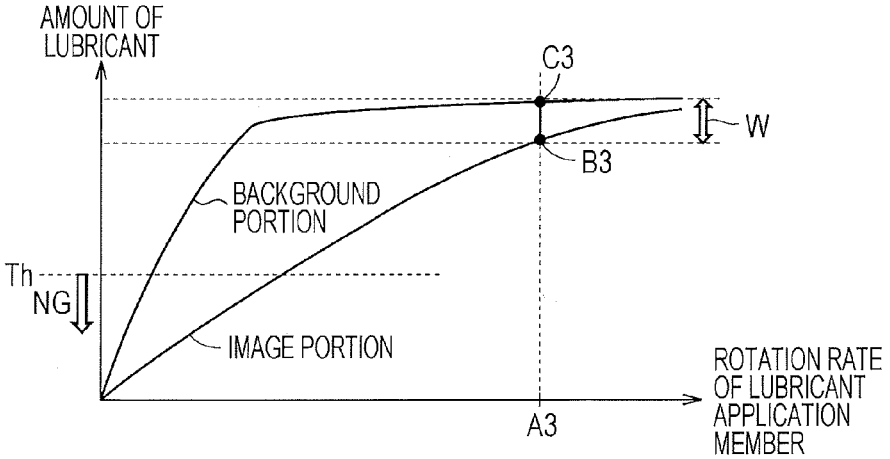

A method of controlling the amount of the lubricant applied, according to the second embodiment will be described with reference to FIGS. 11A and 11B and FIG. 12. FIGS. 11A and 11B are schematic diagrams illustrating the method of controlling the amount of the lubricant applied, which is performed when image patterns 141A to 141D are input.

The specific example of FIG. 11B illustrates the image patterns 141A to 141D each having a difference ΔC between the maximum value Cmax and the minimum value Cmin of the image portion ratio of the respective regions of the image carrier 1 of "0%". When the difference ΔC is "0%", the image unevenness is not caused. Therefore, in this situation, the image forming apparatus 100 preferably controls the amount of the lubricant applied, paying attention only to non-fixation of toner onto the image carrier 1.

More specifically, in an example of the image pattern 141A, the maximum value Cmax of the image portion ratio is "100%". As illustrated in the graph of FIG. 11A, in order to minimize the amount of the lubricant applied without causing the fixation of toner onto the image carrier 1, the image forming apparatus 100 sets the rotation rate of the image carrier 1 to the rotation rate NA.

In an example of the image pattern 141B, the maximum value Cmax of the image portion ratio is "50%". As illustrated in the graph of FIG. 11A, in order to minimize the amount of the lubricant applied without causing the fixation of toner onto the image carrier 1, the image forming apparatus 100 sets the rotation rate of the image carrier 1 to the rotation rate NB. Therefore, the image forming apparatus 100 can reduce lubricant consumption.

In an example of the image pattern 141C, the maximum value Cmax of the image portion ratio is "25%". As illustrated in the graph of FIG. 11A, in order to minimize the amount of the lubricant applied without causing the fixation of toner onto the image carrier 1, the image forming apparatus 100 sets the rotation rate of the image carrier 1 to the rotation rate NC. Therefore, the image forming apparatus 100 can further reduce lubricant consumption.

In an example of the image pattern 141D, the maximum value Cmax of the image portion ratio is "0%". As illustrated in the graph of FIG. 11A, in order to minimize the amount of the lubricant applied without causing the fixation of toner onto the image carrier 1, the image forming apparatus 100 sets the rotation rate of the image carrier 1 to the rotation rate ND. Therefore, the image forming apparatus 100 can further reduce lubricant consumption.

Based on the above description, when the difference ΔC is less than the predetermined value, the image forming apparatus 100 controls the amount of the lubricant applied, according to the maximum value Cmax of the image portion ratio calculated for the respective regions on the surface of the image carrier 1. FIG. 12 is a graph 175 illustrating a relationship between the difference ΔC and the rotation rate of the lubricant application member 7. As illustrated in FIG. 12, when the difference ΔC is less than the predetermined value CA, the image forming apparatus 100 reduces the rotation rate of the image carrier 1, with reduction of the maximum value Cmax of the image portion ratio.

The image forming apparatus 100 according to the present embodiment is configured so that when the difference ΔC is less than the predetermined value, the rotation rate of the lubricant application member 7 is controlled, according to the maximum value Cmax of the image portion ratio. The present embodiment includes two types of control, that is, control of the rotation rate of the lubricant application member 7 according to the difference ΔC to prevent generation of image unevenness, and control of the rotation rate of the lubricant application member 7 according to the maximum value Cmax to prevent fixation of toner onto the image carrier 1. Therefore, the image forming apparatus 100 according to the present embodiment can further reduce lubricant consumption, compared with that of the first embodiment.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include all modifications within the meaning and scope, which are equivalent to the scope of claims.

What is claimed is:

1. An image forming apparatus comprising:

a rotatable image carrier;

an image forming unit configured to form an electrostatic latent image on the image carrier based on information defining at least one of a toner region and a non-toner region;

a development unit configured to develop the electrostatic latent image formed on the image carrier, as a toner image;

a cleaning unit configured to remove toner remaining on the image carrier, after transfer of the toner image;

an application unit configured to apply lubricant on the image carrier; and a hardware processor configured to control an amount of the lubricant applied, said hardware processor configured to:

calculate a image portion ratio of a toner region, for each of regions obtained by dividing a surface of the image carrier in a direction perpendicular to a rotation direction of the image carrier, based on at least one of the information input for a certain period in the past, and the information input for a certain period in the future which is expected from reserved jobs in the image forming apparatus; and control the amount of the lubricant applied according to a difference between a maximum value and a minimum value of the image portion ratio calculated for the respective regions on the surface of the image carrier.

2. The image forming apparatus according to claim 1, wherein when the difference is larger, the hardware processor increases the amount of the lubricant applied.

3. The image forming apparatus according to claim 1, wherein when the difference is less than a predetermined value, the hardware processor controls the amount of the lubricant applied, according to a maximum value of the image portion ratio calculated for the respective regions on the surface of the image carrier.

4. The image forming apparatus according to claim 1, wherein the hardware processor controls the amount of the lubricant applied timely during a predetermined period including an image forming time of the image forming apparatus.

5. The image forming apparatus according to claim 1, wherein the application unit includes a solid lubricant, and a rotation member configured to make contact with the solid lubricant and the image carrier, the rotation member rotates to scrape out lubricant from the solid lubricant, and applies the lubricant over the image carrier, and the hardware processor controls a rotation amount of the rotation member to control the amount of the lubricant applied.

6. A control method in an image forming apparatus including a rotatable image carrier, an image forming unit configured to form an electrostatic latent image on the image carrier based on information defining at least one of a toner region and a non-toner region, a development unit configured to develop the electrostatic latent image formed on the image carrier, as a toner image, a cleaning unit configured to remove toner remaining on the image carrier, after transfer of the toner image, and an application unit configured to apply lubricant on the image carrier, the control method comprising the steps of:

calculating a image portion ratio of a toner region, for each of regions obtained by dividing a surface of the image carrier in a direction perpendicular to a rotation direction of the image carrier, based on at least one of the information input for a certain period in the past, and the information input for a certain period in the future which is expected from reserved jobs in the image forming apparatus; and controlling an amount of the lubricant applied according to a difference between a maximum value and a minimum value of the image portion ratio calculated for the respective regions on the surface of the image carrier.

7. A non-transitory computer-readable recording medium recording a program for causing a computer in an image forming apparatus to perform the control method according to claim 6.

8. The recording medium according to claim 7, wherein the program causes the computer to further execute the step of:

increasing the amount of the lubricant applied, when the difference is larger.

9. The recording medium according to claim 7, wherein the program causes the computer to further execute the step of:

controlling the amount of the lubricant applied, according to a maximum value of the image portion ratio calculated for the respective regions on the surface of the image carrier, when the difference is less than a predetermined value.

10. The recording medium according to claim 7, wherein the program causes the computer to further execute the step of:

controlling the amount of the lubricant applied timely during a predetermined period including an image forming time of the image forming apparatus.

11. An image forming apparatus executing a program recorded in the recording medium according to claim 7, wherein an application unit includes a solid lubricant, and a rotation member making contact with the solid lubricant and the image carrier, and the rotation member rotates to apply lubricant scraped out from the solid lubricant over the image carrier, wherein the program causes the computer to further execute the step of:

controlling a rotation amount of the rotation member to control an amount of the lubricant applied.

* * * * *